United States Patent [19]

Law

[11] 3,934,434

[45] Jan. 27, 1976

[54] KEY SAFE APPARATUS

[76] Inventor: Jack Law, 910 Alakea St., Honolulu, Hawaii 96813

[22] Filed: Sept. 24, 1973

[21] Appl. No.: 399,739

[52] U.S. Cl. ..... 70/63; 70/63

[51] Int. Cl.[2] ..... E05B 65/52

[58] Field of Search ..... 70/63, 14, 57–58; 109/50, 51; 232/4 R, 42; 220/29, 41, 3.8; 217/62; 206/1.5

[56] References Cited

UNITED STATES PATENTS

| | | | |
|---|---|---|---|
| 2,273,580 | 2/1942 | Kruschwitz | 232/43.5 |
| 2,723,484 | 11/1955 | Nelson | 220/41 X |
| 3,029,965 | 4/1962 | Maier | 220/3.8 |
| 3,236,075 | 2/1966 | Williams | 70/63 |
| 3,436,937 | 4/1969 | Berrett | 70/63 |
| 3,590,614 | 7/1971 | Kurst | 70/298 |
| 3,742,741 | 7/1973 | Cahan | 70/63 |
| 3,744,281 | 7/1973 | Logue | 70/58 |

*Primary Examiner*—Robert L. Wolfe
*Attorney, Agent, or Firm*—James C. Wray

[57] ABSTRACT

A key safe apparatus has a vertically slotted receptacle box which is locked onto a lid structure formed with vertical tongue capable of interengaging the slot in the receptacle box. The lid is fastened to the box by a code lock whose combination may be recoded. The key safe is structured to be fastened to a door whose key may be locked in the receptacle box. The fastening is accomplished by a bracket attached to the lid structure and fitted over a margin of the door. In another configuration, the key safe is locked around a door knob.

17 Claims, 5 Drawing Figures

KEY SAFE APPARATUS

BACKGROUND OF THE INVENTION

The invention described herein concerns key safes into which a door key may be placed and securely locked. Conventional key safes employ key locks and hinged doors on removable key drawers. The object of this invention is to provide an easily fabricated, structurely sound key safe which may be securely attached to a door and which may be opened by any number of designated persons without the necessity of providing each person with a key for a key safe.

A collection of devices of the type known in the prior art is found in the Official United States Patent Office Classification of Patents, particularly in Class 70, subclasses 63, 58 and 57. Examples of such devices are found in U.S. Pat. Nos.: 1,613,813, 2,512,028, 2,911,814, 3,204,436, 3,236,075, 3,347,069, 3,436,937, 3,636,742 and 3,695,067.

A prior invention described in U.S. Pat. No. 3,236,075 employs a key lock to fasten a protective housing to back plate on which a door key may be fastened. A rotatable projection on the key lock engages the back plate and maintains the housing in position. The key safe in this invention is attached to a U-shaped bracket which may be fitted on the margin of a door. In another configuration, the device is equipped with a U-bolt which may be clamped about a door knob by inserting a pin through the U-bolt and thereby pinning the U-bolt to the key safe at a point where the U-bolt passes through the key safe.

In the known invention described in U.S. Pat. No. 3,347,069, a security container is designed with a hinged lid which may be locked in a closed position by means of a built-in recodeable code lock or a built-in key lock.

In conventional key safe apparatus, a door key may be stored in a box-shaped drawer which may be inserted into a receptacle box. The drawer is locked in place by means of a key lock. The receptacle box is equipped with a U-shaped bracket to engage a margin of a door.

A need exists for an easily and cheaply fabricated key safe of great structural strength. A need also exists for a key safe which may be conveniently opened by any number of designated persons without the necessity of providing each person with a key for the key safe. Such a key safe must be equipped with means to firmly fasten the safe to a door so that the safe cannot be removed by unauthorized parties.

SUMMARY OF THE INVENTION

The present invention is a key safe apparatus which is employed to securely store a door key. The door key is retained in a receptacle box to which a cover structure is locked by means of a coded combination lock. The key safe is firmly attached to a door.

The invention concerns an item that fastens to the jam of a door, or almost any place on the exterior of a house or an apartment for the purpose of concealing a key to the main entrance to be used by real estate brokers, salesmen, etc. A conventional invention serves the same purpose but is operated by a master key. This key opens a small box which holds the front door key. The key that opens the box is kept by a real estate salesman, and this same key may open dozens of boxes attached to houses he has listed when the owners are out or away and don't want to leave the key under the mat.

The present invention replaces the key and lock mechanism with a combination lock.

In a preferred embodiment, the code combination lock may be recoded by adjusting the lock mechanism inside the receptacle box. The code combination is given to selected persons who need access to the particular structures whose keys are contained in the key safe. If a particular code combination becomes unusable because it is identical to another code combination in use or because the wrong persons have access to the combination, etc., then a pin that regulates the activating numbers on the lock may be changed, thereby changing the combination.

The code combination lock may be constructed with a single dial or a plurality of coaxial dials. The axes of rotation of the dials may be parallel or perpendicular to a face of the receptacle box.

In another preferred embodiment, the body of the key safe is composed of a vertically slotted receptacle box and tongued cover structure which is capable of interengaging with the slot in the receptacle box. The receptacle box has four, generally rectilinear, vertical side walls and a solid bottom. The box is of sufficient volume to enclose a door key. A rear vertical side wall is formed with a slot running vertically downward from an upper edge of the rear side wall. The slot is formed by an aperture in the rear vertical wall which has vertical edges bevelled in such a way that the slot is wider in a plane of the interior face of the rear vertical side wall than it is in the plane of the exterior face.

A tongued lid structure covers the upper mouth of the receptacle box. The lid structure is composed of a horizontal cover plate and a vertical back plate attached to the rear edge of the horizontal plate and extending generally perpendicularly downward therefrom. A vertical tongue member is welded to the vertical back plate. The tongue member is formed with bevelled vertical edges. The tongue member is wider in the plane of the front face than it is in the plane of its rear face. The slot in the receptacle box and the tongue member are so dimensioned that they may be interengaged by keying the tongue member into the slot and sliding it downward until the horizontal cover plate contacts the mouth of the receptacle box.

In one form of the preferred embodiment, the tongued cover and receptacle box are chrome plated.

In another preferred embodiment, the code lock is attached to a front vertical side wall of the receptacle box. A latching projection is welded to the cover plate and extends vertically downward therefrom. The latching projection is formed with hook-like ends which engage the code lock and prevent the key safe cover from being removed.

In another embodiment, the receptacle box is equipped with means for fastening the door key to one of its walls. In one form, a swivel-mounted, spring-loaded key retainer is attached to a wall of the receptacle box. The key can be disengaged from the retainer by compressing the retainer's spring-loaded member and slipping the key off of a shaft passing through the hole in the key. The key is blocked from slipping off the shaft when the spring member is in its relaxed configuration.

In another preferred embodiment, a U-shaped bracket is attached to the cover structure. The bracket is adapted to fit around the margin of a door and firmly fix the key safe to the door. A first member of the bracket is intended to contact a principal face of the door. A second member of the bracket is attached to an edge of the first member and extends perpendicularly from the second member in the same direction as the first member. The third member is intended to engage a principal face of the door opposite the principal face contacted by the first member.

In one form of the preferred embodiment, the bracket is made of spring steel, and the third member is bent in a dog leg so that the third member exerts pressure on the face of the door when the bracket is set in place.

In another form of the preferred embodiment, the bracket is chrome plated.

When the U-shaped bracket is employed, the key safe may be attached to the door in such a way that it can only be removed by a person with the lock combination. The bracket fitted about the margin of the door cannot be dislodged without first opening the door. Since access must be had to the door key in order to open the door, the key safe cannot be removed by unauthorized persons.

In another preferred embodiment, the key safe is fixed to the door by engaging the door's handle. In one form in which the tongued cover is employed, the slot in the receptacle box is made longer than the tongue so that an aperture remains in the rear wall of the key safe when the cover is locked on the receptacle box. A door knob may thus be enclosed by the receptacle box, and the door knob shaft may pass through the aperture in the rear wall. In this configuration, the kay safe cannot be detached from the door without removing the tongued cover.

In another form of the preferred embodiment, a vertical plate is attached to the rear edge of the cover and extends perpendicularly upward and downward. An aperture is formed in the upward extending portion of the vertical plate. The rear side wall of the receptacle box is elongated so that it extends beyond the lowest edge of the aperture when the cover assembly is locked in place. In this configuration, a broad portion of a door handle is passed through the aperture and then the aperture is constricted about a narrower portion of the door handle so that the key safe is locked onto the door handle.

In another form of the preferred embodiment, a generally U-shaped bolt has a first leg vertically and rotatably mounted to the cover structure. The U-shaped bolt extends upward from its rotatable mount, bends back on itself and extends downward through the cover plate so that a second leg of the bolt is parallel to the first leg. An elongated aperture is formed in the cover plate and extends to an edge of the cover plate. The second leg of the U-shaped bolt passes through the aperture. An annular bushing is attached to the lower end of the second vertical leg to prevent the leg from being withdrawn from the cover plate in a vertical direction. In this configuration, the U-shaped bolt may be locked about a shaft supporting a door knob by slipping the U-shaped bolt around the door knob shaft, by rotating the cover plate into a position wherein the second leg of the U-shaped bolt passes through the elongated aperture, and by locking the cover plate to the receptacle box so that a vertical side wall of the receptacle box serves as a stop for the second leg to prevent the U-shaped bolt from rotating to a position wherein the second leg no longer passes through the elongated aperture in the horizontal plate.

An object of this invention is to provide an easily fabricated and structurally sound key safe which may be attached to a door.

Another object of this invention is to provide a key safe with a code combination locking means.

Another object of this invention is to provide a key safe with a recodeable combination lock which may be opened only by designated persons possessing the combination.

Another object of this invention is to provide a code-locking key safe which can be firmly attached to the margin of a door.

Another object of this invention is to provide a code-locking key safe which may be locked onto a door knob.

These and other objects and features of the invention are apparent from the disclosure, which includes the specification with the foregoing and ongoing description and with the claims, and which includes the drawings.

DETAILED DESCRIPTION OF THE DRAWINGS

Figure 1:
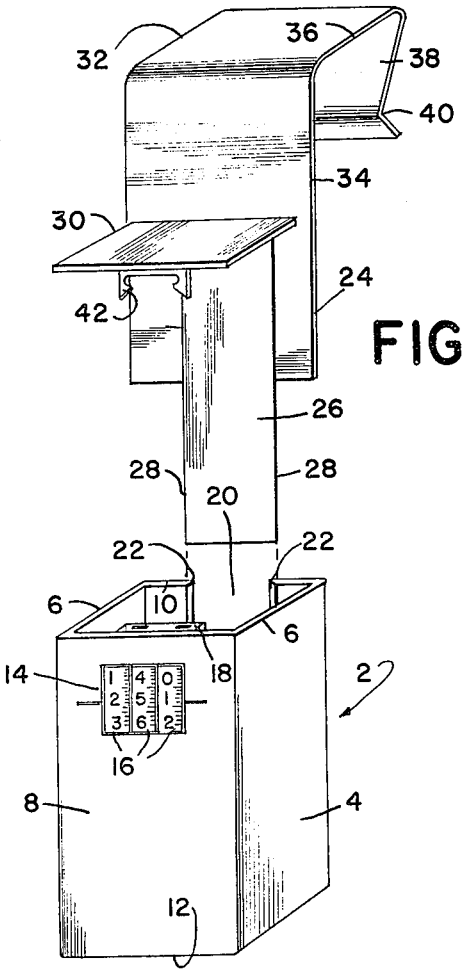
FIG. 1 is a perspective front elevation of the key safe apparatus of the present invention showing the position of the receptacle box and cover prior to locking.

Referring to the figures, a key safe apparatus is denoted generally by the numeral 2. In FIG. 1, the receptacle box structure 4 and the cover structure 24 are shown in a detached position.

The receptacle box is composed of two vertical side walls 6, a vertical front wall 8, a vertical back wall 10 and a solid bottom 12. In a preferred embodiment, a recodeable combination lock 14 is mounted in the front wall. Movable dials 16 are accessible from the outside of the receptacle box. The combination lock body 18 is housed by the receptacle box and is capable of engaging latching projection 42.

The cover structure 24 is composed of a horizontal lid plate 30 which covers the receptacle box mouth and, in a preferred embodiment, a tongue member 26. The edges 28 of the tongue member are bevelled to key into a slot 20 in the receptacle box whose edges 22 are bevelled at an angle complementary to the angle of the edges of the tongue member.

In a preferred embodiment, a vertical plate 34 is fastened to the rear edge of the horizontal lid plate and extends vertically upward and downward therefrom. A door mounting bracket 32 is formed on the upper portion of the vertical plate. The bracket is composed of the vertical plate, a horizontal plate 36 attached to the upper edge of the vertical plate, and a second, generally vertical plate 35 formed with a dog leg 40. The bracket may be fitted over the margin of a door in order to secure the key safe to the door.

Figure 2:
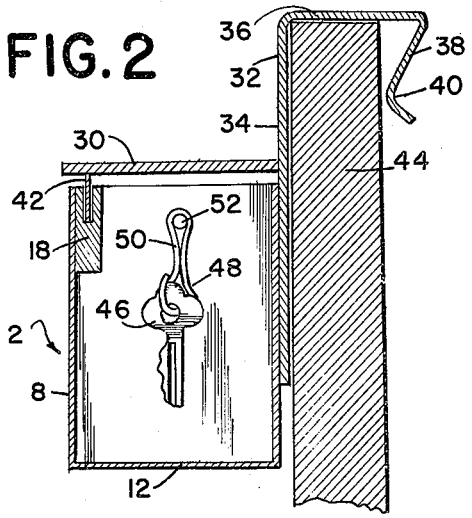
FIG. 2 is a cross-sectional side elevation of the key safe apparatus locked and bracketed to a door margin.

FIG. 2 is a cross-sectional side elevation of the key safe apparatus of FIG. 1 showing the bracket 32 engaging the margin of a door 44. The dog leg bend 40 in the spring steel bracket exerts pressure on a face of the door, maintaining the key safe in position.

The key safe of FIG. 2 is shown in a locked position. The latching projection 42 is engaged by the lock body 18.

A key 46 is fastened to a side wall of the key safe by a snap lock 48 with a spring-loaded member 50. The key and snap lock are mounted to the side wall by pivot mount 52.

Figure 3:
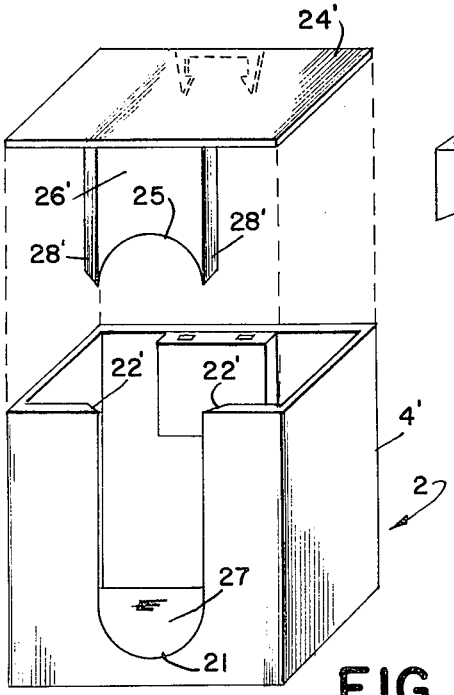
FIG. 3 is a perspective rear elevation of the key safe apparatus showing the door knob enclosing modification of a preferred embodiment.

FIG. 3 is a perspective rear elevation of a key safe showing the bevelled edges 28′ of the tongue member 26′ and the cooperating edges 22′ of the slot 27 in the receptacle box, which edges are bevelled at an angle complementary to the angle of the bevel of the edges of the tongue member. The figure also shows a preferred embodiment of the key safe apparatus adapted to be mounted on a door knob. The receptacle box 4′ can be slipped around a door knob and the cover structure 24′ locked in place so that the shaft on which the door knob is mounted passes through an aperture in the key safe delineated by a curved edge 21 of the receptacle box and a second curved edge 25 of the tongue member.

Figure 4:
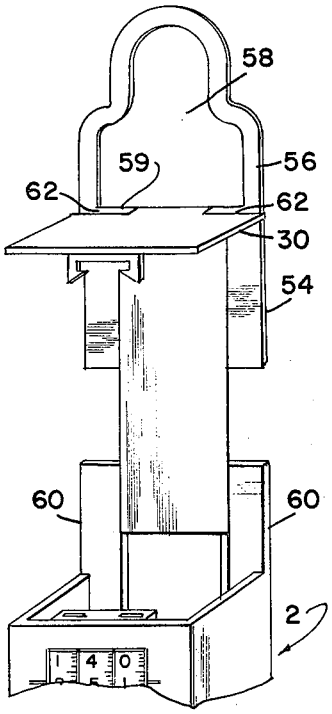
FIG. 4 is a perspective front elevation of the key safe apparatus showing a door knob encircling cover structure of a preferred embodiment.

FIG. 4 shows a perspective front elevation of a door knob engaging key safe apparatus.

A vertical plate 54 attached to the horizontal cover plate 30 is formed with an aperture 58 in its upper portion 56. The rear walls 60 of the receptacle box are elongated so that they extend beyond the lower edge 59 of the aperture 58 when the cover plate is locked on the receptacle box. In this configuration a door knob may be passed through the aperture in the cover structure, and then the aperture may be constricted by locking the cover structure to the receptacle box. This prevents the key safe from being removed from the door knob.

Figure 5:
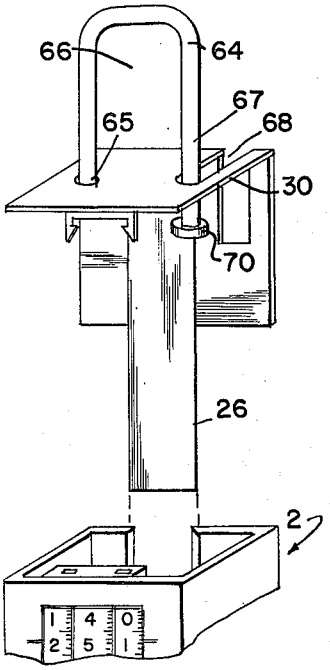
FIG. 5 is a perspective front elevation of the key safe apparatus showing another door knob encircling cover structure of a preferred embodiment.

FIG. 5 is a perspective front elevation of another embodiment of the key safe apparatus. A U-bolt 64 is fixed to a rotatable mounting 65 in the cover plate 30. The area encircled by the U-bolt 66 is sufficient to accommodate a shaft on which a door knob is mounted. The key safe apparatus may be locked to the door knob by slipping the U-bolt over the door knob shaft, rotating the cover plate 30 so that a second leg 67 of the U-bolt passes into an aperture 68 in the cover structure, and locking the cover structure to the receptacle box. When so assembled, the key safe cannot be detached from the door knob, because the second leg 67 of the U-bolt cannot be rotated out of the aperture 68. This is so because the rear wall 10 of the receptacle box restricts the rotational movement of the U-bolt. A bushing 70 restricts the upward vertical movement of the U-bolt.

While the invention has been described with reference to specific embodiments, it will be obvious that modifications and variations may be constructed without departing from the spirit and scope of the invention. The scope of the invention is described in the following claims.

I claim:

1. A key safe apparatus comprising:

a receptacle box of a volume sufficient to enclose a door key, with four, generally rectilinear, vertical side walls and a bottom wall wherein a vertical side wall is formed with a slot structure running vertically downward from an upper edge of the vertical side wall, which slot structure has vertical edges bevelled in such a way that the slot structure is wider in a plane of an interior face of the vertical side wall than it is in a plane of an exterior face of the vertical side wall, a tongued cover structure comprising a plate capable of covering the receptacle box and a bevelled tongue member attached to the plate and extending therefrom, which tongue member is formed with bevelled edges and which tongue member is wider in a plane of one principal face of the tongue member than it is in a plane of another principal face of the tongue member so that the tongue member may be keyed into the slot structure of the receptacle box, a latching projection attached to the plate of the tongued cover structure and extending therefrom, and a code lock structure engaging the latching projection attached to the plate, whereby a door key is securely encased in a receptacle box with a tongued cover structure locked to a receptacle box by means of a code lock.

2. The key safe apparatus of claim 1 wherein the code lock structure is recodeable when the cover structure is removed, whereby a combination code necessary to open the lock is changed by recoding the code lock when the lid structure is removed.

3. The key safe apparatus of claim 1 further comprising a vertical back plate attached to the horizontal plate and extending vertically downward therefrom to which the tongue member is spot welded.

4. The key safe apparatus of claim 1 further comprising a mounting means attached to the tongued cover structure formed in a generally U-shaped configuration and adapted to fit around the edge of a door, said mounting means comprising a first vertical member attached to the tongued cover structure capable of being located next to one principal face of the door, a second horizontal member connecting an upper end of the first vertical member to an upper end of a third vertical member, and the third vertical member of the mounting means capable of being located next to a second principal face of the door, whereby a door key is securely encased in a lockable, slotted receptacle box which may be fitted onto a margin of a door.

5. The key safe apparatus of claim 4 wherein the mounting means comprises a vertical wall attached to the horizontal plate with an aperture so formed that when the tongued cover structure is locked to the receptacle box structure, the receptacle box structure constricts the aperture by obstructing a portion of it, whereby the key safe apparatus is fixed to a door handle and locked in that fixed position by locking the tongued cover structure to the receptacle box structure.

6. The key safe apparatus of claim 5 wherein the vertical wall of the tongued cover structure is formed with an aperture in its principal face above a point of attachment with the horizontal plate of the lid structure and a rear, vertical side wall of the receptacle box is formed with a portion thereof extending vertically upward beyond the lower edge of the aperture when the tongued cover structure is locked to the receptacle box, whereby the key safe may be locked about a narrowed portion of a door handle by passing a door knob through the aperture in the tongued cover structure, by locating the aperture so that it encircles a shaft connecting the door knob to the door, and by constricting the aperture in the tongued cover structure to a size smaller than the door knob by locking the tongued cover structure to the receptacle box structure.

7. The key safe apparatus of claim 5 further comprising:

a generally U-shaped bolt extending vertically upward from the horizontal plate of the tongued cover structure comprising a first, vertical leg rotatably mounted to the tongued cover structure and joined at its upper extremity to an upper extremity of a second, vertical leg, generally parallel to the first vertical leg, which second vertical leg passes through the lid structure, an elongated aperture in the horizontal plate of the tongued cover structure extending to an edge of the horizontal plate, through which the second vertical leg of the U-shaped bolt passes, and an annular bushing attached to the lower end of the second vertical leg to prevent the second vertical leg from being withdrawn from the horizontal plate in a vertical direction, whereby the U-shaped bolt may be locked about a shaft supporting a door knob by slipping the U-bolt over the shaft supporting a door knob, by rotating the horizontal plate into a position wherein the second leg of the U-shaped bolt passes through the elongated aperture, and by locking the horizontal plate to the receptacle box so that a vertical side wall of the receptacle box serves as a stop for the second leg to prevent the U-shaped bolt from rotating to a position wherein the second leg no longer passes through the elongated aperture in the horizontal plate.

8. The key safe apparatus of claim 1 wherein the receptacle box is equipped with means for fastening a key to an interior face of a wall of the receptacle box.

9. The key safe apparatus of claim 1 wherein the tongued cover structure is equipped with means for fastening a key to an interior face of the horizontal plate of the tongued cover structure.

10. The key safe apparatus of claim 1 wherein the mounting means comprises an aperture in a vertical wall of the tongued cover structure so formed that when the tongued cover structure is locked to the receptacle box structure, the receptacle box structure constricts the aperture in the vertical wall of the tongued cover structure and obstructs the aperture, whereby the key safe apparatus is fixed to a door handle and locked in that fixed position by locking the tongued cover structure to the receptacle box structure.

11. The key safe apparatus of claim 10 wherein the vertical wall of the tongued cover structure is formed with an aperture in its principal face above a point of attachment with the horizontal plate of the lid structure and a rear, vertical side wall of the receptacle box is formed with a portion thereof extending vertically upward beyond the lower edge of the aperture when the tongued cover structure is locked to the receptacle box, whereby the key safe may be locked about a narrow portion of a door handle by passing a door knob through the aperture so that it encircles a shaft connecting the door knob to the door, and by constricting the aperture in the tongued cover structure to a size smaller than the door knob by locking the tongued cover structure to the receptacle box structure.

12. The key safe apparatus of claim 10 further comprising:

a generally U-shaped bolt extending vertically upward from the horizontal plate of the tongued cover structure comprising a first, vertical leg rotatably mounted to the tongued cover structure and joined at its upper extremity to an upper extremity of a second, vertical leg, generally parallel to the first vertical leg, which second vertical leg passes through the lid structure, an elongated aperture in the horizontal plate of the tongued cover structure extending to an edge of the horizontal plate, through which the second vertical leg of the U-shaped bolt passes, and an annular bushing attached to the lower end of the second vertical leg to prevent the second vertical leg from being withdrawn from the horizontal plate in a vertical direction, whereby the U-shaped bolt may be locked about a shaft supporting a door knob by slipping the U-bolt over the shaft supporting a door knob, by rotating the horizontal plate into a position wherein the second leg of the U-shaped bolt passes through the elongated aperture, and by locking the horizontal plate to the receptacle box so that a vertical side wall of the receptacle box serves as a stop for the second leg to prevent the U-shaped bolt from rotating to a position wherein the second leg no longer passes through the elongated aperture in the horizontal plate.

13. The key safe apparatus of claim 1 wherein the cover means comprises a lid structure and a mounting means comprising a vertical wall attached to the lid structure with an aperture so formed that when the lid structure is locked to the receptacle box structure, the receptacle box structure constricts the aperture in the vertical wall of the lid structure by obstructing a portion of the aperture, whereby the key safe apparatus is fixed to a door handle and locked in that fixed position by locking the lid structure to the receptacle box structure.

14. The key safe apparatus of claim 13 wherein the vertical wall of the lid structure is formed with an aperture in its principal face above a point of attachment with the horizontal plate of the lid structure, and a rear, vertical side wall of the receptacle box is formed with a portion extending vertically upward beyond a lower edge of the aperture when the lid structure is locked to the receptacle box, whereby the key safe may be locked about a narrowed portion of a door handle by passing a door knob through the aperture in the lid structure, by locating the aperture so that it encircles a shaft connecting the door knob to the door, and by constricting the aperture in the lid structure to a size smaller than the door know by locking the lid structure to the receptacle box structure.

15. The key safe apparatus of claim 13 further comprising:

a generally U-shaped bolt extending vertically upward from the horizontal plate of the lid structure, comprising a first vertical leg rotatably mounted to the lid structure and joined at its upper extremity to an upper extremity of a second vertical leg, parallel to the first vertical leg and passing through the lid structure, an elongated aperture in the horizontal plate, extending to an edge of the horizontal plate, through which the second vertical leg of the U-shaped bolt passes, and an annular bushing attached to the lower end of the second vertical leg to prevent the second vertical leg from being withdrawn from the horizontal lid in a vertical direction, whereby the U-shaped bolt may be locked about a shaft supporting a door knob by slipping the U-bolt over the shaft supporting a door knob, by rotating the horizontal plate into a position wherein the second leg of the U-shaped bolt passes through the elongated aperture, and by locking the horizontal plate to the receptacle box so that a vertical side wall of the receptacle box serves as a stop for the second leg to prevent the U-shaped bolt from rotating to a position where the second leg no longer passes through the elongated aperture in the horizontal plate.

16. A key safe apparatus comprising:

a receptacle box of a volume sufficient to enclose a door key with four, generally rectilinear, vertical side walls and a bottom wall where a vertical side wall is formed with a slot structure running vertically downward from an upper edge of the vertical side wall, which slot structure has vertical edges bevelled in such a way that the slot structure is wider in a plane of an interior face of the vertical side wall than it is in a plane of an exterior face of the vertical side wall, a tongued cover structure comprising a plate capable of covering of the receptacle box and bevelled tongue member attached to the plate and extending therefrom, which tongue member is formed with bevelled edges and which tongue member is wider in a plane of one principal face of the tongue member than it is in a plane of another principal face of the tongue member so that the tongue member may be keyed into the slot structure of the receptacle box, a latching projection attached to the plate of the tongued cover structure and extending therefrom, a lock structure engaging the latching projection attached to the plate, and a mounting means attached to the tongued cover structure, formed in a generally U-shaped configuration, and adapted to fit around an edge of a door, said mounting means comprising a first, vertical member attached to the tongued cover structure, capable of being located next to one principal face of the door, a second, horizontal member connecting an upper end of the first vertical member to an upper end of a third, vertical member, and the third, vertical member of the mounting means capable of being located next to a second principal face of the door, whereby a door key is securely encased in a receptacle box structure bracketed to an edge of a door.

17. A key safe apparatus comprising:

a receptacle box structure of a volume sufficient to enclose a door key with four, generally rectilinear, vertical side walls and a bottom wall where a vertical side wall is formed with a slot running vertically downward, which slot structure has vertical edges extending from a plane of an interior face of the vertical side wall to a plane of an exterior face of the vertical side wall, a tongued cover structure comprising a plate capable of covering the receptacle box slot and bevelled tongue member attached to the plate and extending vertically downward therefrom, which tongue member is formed with bevelled edges and which tongue member is wider in a plane of one principal face of the tongue member than it is in a plane of another principal face of the tongue member so that the tongue member may be keyed into the slot structure of the receptacle box, a latching projection attached to the plate of the tongued cover structure and extending therefrom, a code lock structure engaging the latching projection attached to the plate, and a mounting means attached to the structure, formed in a generally U-shaped configuration, and adapted to fit around an element of a door, said mounting means comprising a first, vertical member attached to the structure, capable of being located next to one principal face of the door, a second, horizontal member connecting an upper end of the first vertical member to an upper end of a third, vertical member, and the third, vertical member of the mounting means capable of being located next to a principal face of the door, whereby a door key is securely encased in a receptacle box structure attached to a door.

* * * * *